US007713114B1

(12) United States Patent
Paynton et al.

(10) Patent No.: US 7,713,114 B1
(45) Date of Patent: May 11, 2010

(54) CHIMNEY CAP

(75) Inventors: William C. Paynton, North Attleboro, MA (US); Richard H. Paynton, North Attleboro, MA (US)

(73) Assignee: Improved Cosumer Products Inc., Attleboro Falls, MA (US)

( * ) Notice: Subject to any disclaimer, the term of this patent is extended or adjusted under 35 U.S.C. 154(b) by 219 days.

(21) Appl. No.: 11/879,436

(22) Filed: Jul. 17, 2007

(51) Int. Cl.
*F23L 17/02* (2006.01)
*F23L 17/12* (2006.01)

(52) U.S. Cl. ..... 454/12; 454/35; 454/36; 454/37; 454/38

(58) Field of Classification Search ..... 454/12, 454/13, 14, 35, 44, 3, 4, 8, 36, 37, 38
See application file for complete search history.

(56) References Cited

U.S. PATENT DOCUMENTS

| | | | | | |
|---|---|---|---|---|---|
| 1,301,096 | A * | 4/1919 | Brockest | 285/334.4 |
| 1,337,731 | A * | 4/1920 | Speaks | 454/40 |
| 1,783,406 | A * | 12/1930 | Cibulas | 454/33 |
| 1,888,290 | A * | 11/1932 | Rhinow | 454/12 |
| 2,242,468 | A * | 5/1941 | Holub | 285/183 |
| 2,381,178 | A * | 8/1945 | Munyon | 52/244 |
| 2,878,838 | A * | 3/1959 | Budge et al. | 285/189 |
| 2,988,982 | A * | 6/1961 | Brewer | 454/34 |
| 2,994,260 | A * | 8/1961 | Millett | 454/24 |
| 4,325,291 | A | 4/1982 | Paynton et al. | |
| 4,384,617 | A * | 5/1983 | Mueller | 169/57 |
| 4,777,871 | A * | 10/1988 | Stowell | 454/12 |
| 4,846,512 | A * | 7/1989 | Karakawa | 285/424 |
| 4,878,326 | A * | 11/1989 | Sass | 52/218 |
| 5,609,522 | A * | 3/1997 | Szwartz | 454/7 |
| 6,852,023 | B2 * | 2/2005 | Hediger et al. | 454/44 |
| 7,014,555 | B1 * | 3/2006 | Issod | 454/44 |

FOREIGN PATENT DOCUMENTS

EP 182534 A1 * 5/1986

OTHER PUBLICATIONS

2005 Product Catalog of Improved Consumer Products, Inc., Chimney Cap Model Nos. WSA and WSA-TDW (p. 12).

* cited by examiner

*Primary Examiner*—Steven B McAllister
*Assistant Examiner*—Patrick F. O'Reilly, III
(74) *Attorney, Agent, or Firm*—John Brooks Law LLC; John J Brooks, III

(57) ABSTRACT

A cap capable of being secured to a chimney or flue of either air cooled or non-air cooled type and including a base, an annular collar member for insertion into a chimney or flue, an annular shaped mesh member that is supported from the base; a top supported on the annular shaped mesh member, means supported from an outer surface of the collar member below the base and forming a ledge for support of the collar member from the chimney or flue, and an over lap joint including a lower segment that extends substantially longitudinal of the collar member and a top segment that extends diagonal to the lower segment enabling compression of the diameter of the collar member.

14 Claims, 16 Drawing Sheets

CHIMNEY CAP

TECHNICAL FIELD

The present invention relates generally to chimney caps and more particularly to an improved chimney cap that is more universal in construction and that can be used with both air cooled and non-air cooled chimneys.

BACKGROUND OF THE INVENTION

Chimney caps are presently provided in many different shapes and forms. In one sense chimney caps can be basically broken down into two categories, namely those used with regular or non-air-cooled chimney structures and those used with air-cooled chimney structures. Presently, there are two separate cap designs that are used, one for use with non-cooled chimney structures and a different cap for use with air cooled chimney structures. Thus, the cap is specifically designed for each chimney type to which it is to be mounted. By way of example these different types of chimney caps are shown in the 2005 Product Catalog of Improved Consumer Products, Inc. on page and identified as respective models WSA and WSA-TDW.

Reference is now also made to FIGS. 1-4 herein for an illustration of these existing chimney caps. FIG. 1 is a perspective view of a prior art chimney cap used with a non-air-cooled chimney structure. FIG. 2 is a cross-sectional view taken along lines 2-2 of FIG. 1. FIG. 3 is a perspective view of a prior art chimney cap used with an air-cooled chimney structure. FIG. 4 is a cross-sectional view taken along line 4-4 of FIG. 3.

In the first embodiment in FIGS. 1 and 2 the chimney cap includes a base 10 that has the collar 14 depending therefrom. As shown in FIG. 2, the collar 14 extends into the chimney or flue member 15. The collar is formed with an overlap edge 13 that makes the collar somewhat compressible so that it can be fit inside the chimney member 15. The installer can press on the collar to reduce the diameter thereof and once inserted in the flue it expands back toward its original diameter to hold the cap in place. The chimney cap also includes the top 12 and mesh screen 16. The mesh screen 16 assists in containing sparks within the cap. A hoop 18 is supported above the collar 14. The mesh screen 16 is supported on the periphery of the base 10. The mesh screen 16 and top 12 are maintained in place by means of the fastener 20 engaging with the support hoop 18. In FIG. 2 it is noted that the base 10 rests directly on the top edge of the chimney structure 15 and that the exhaust flow, as depicted by arrows 17, is through the collar 14 and peripherally outward through the mesh screen 16

In the second embodiment shown in FIGS. 3 and 4 the chimney cap includes a base 30 that has the collar 34 depending therefrom. As shown in FIG. 4, the collar 34 extends into the chimney member 35. The collar is formed with an overlap edge 33 that makes the collar somewhat compressible so that it can be fit inside the chimney member 35. The chimney cap also includes the top 32 and mesh screen 36. The mesh screen 36 assists in containing sparks within the cap. A hoop 38 is supported above the collar 34. The mesh screen 36 is supported on the periphery of the base 30. The mesh screen 36 and top 32 are maintained in place by means of the fastener 40 engaging with the support hoop 38.

In FIG. 4 it is noted that the base 30 is provided with three wings 31 that are each attached to the base 30. The bottom edge of each wing 31 is adapted to rest directly on the top edge of the chimney structure 35 and the exhaust flow, as depicted by arrows 37, is through the collar 34 and peripherally outward through the mesh screen 36. FIG. 4 also shows additional details of the chimney structure 35 which includes separate air cool ducts 35A and 35B. FIG. 4 also shows the air flow through the ducts as illustrated by the arrows 39. This flow is also about the wings 31 and between adjacent wings.

An object of the present invention is to provide a chimney cap that is more universal in construction and that can be used with both air cooled and non-air cooled chimneys.

Another object of the present invention is to provide an improved chimney cap structure in which the chimney collar is constructed and arranged so that it can be more readily compressed for insertion into virtually any type or style chimney.

Still another object of the present invention is to provide an improved chimney cap which is durable and long lasting.

An even further object of the invention is to provide an improved chimney cap that is inexpensive to manufacture and that is easy to install.

SUMMARY OF THE INVENTION

The foregoing and other objects of the invention are attained by a chimney cap capable of being secured to a chimney or flue of either air cooled or non-air cooled type and comprising: a base; an annular collar member for insertion into a chimney or flue, said annular member having an outside circumference smaller than an opening of the chimney or flue and supported from the base; an annular shaped mesh member that is supported from the base; and a top supported on the annular shaped mesh member. The improvement comprises means supported from an outer surface of the collar member below the base and forming a ledge for support of the collar member from the chimney or flue.

A second feature of the present invention relates to a cap capable of being secured to a chimney or flue and comprising: a base; an annular collar member for insertion into the chimney or flue, with the annular member having an outside circumference smaller than an opening of the chimney or flue and supported from the base; an annular shaped mesh member that is supported from the base; and a top supported on the annular shaped mesh member, with the annular collar member having an over lap joint. The improvement comprises an over lap joint including a lower segment that extends substantially longitudinal of the collar member and a top segment that extends diagonal to the lower segment enabling compression of the diameter of the collar member. The collar member may be attached at its top to the base and the top segment is tapered terminating at the base.

In accordance with other aspects of the present invention the means forming a ledge may include a cut-out piece that is folded to form the ledge, with the ledge extending orthogonal to the outer surface of the collar member; plural cut-out pieces may be disposed at predetermined locations about the collar member; the means forming a ledge may comprise plural separate means disposed at predetermined locations about the collar member; the means forming a ledge may include a series of bolts disposed at intervals about the collar member and each extending outward radially; the means forming a ledge may include a band member having separately disposed ledge walls; the annular collar member may have an over lap joint and the over lap joint may include a lower segment that extends substantially longitudinal of the collar member and a top segment that extends diagonal to the lower segment enabling compression of the diameter of the collar member.

DESCRIPTION OF THE DRAWINGS

These and other objects, advantages and novel features of the present invention will become apparent from the following detailed description of the invention when considered in conjunction with the accompanying drawings, in which.

DETAILED DESCRIPTION

Figure 10:
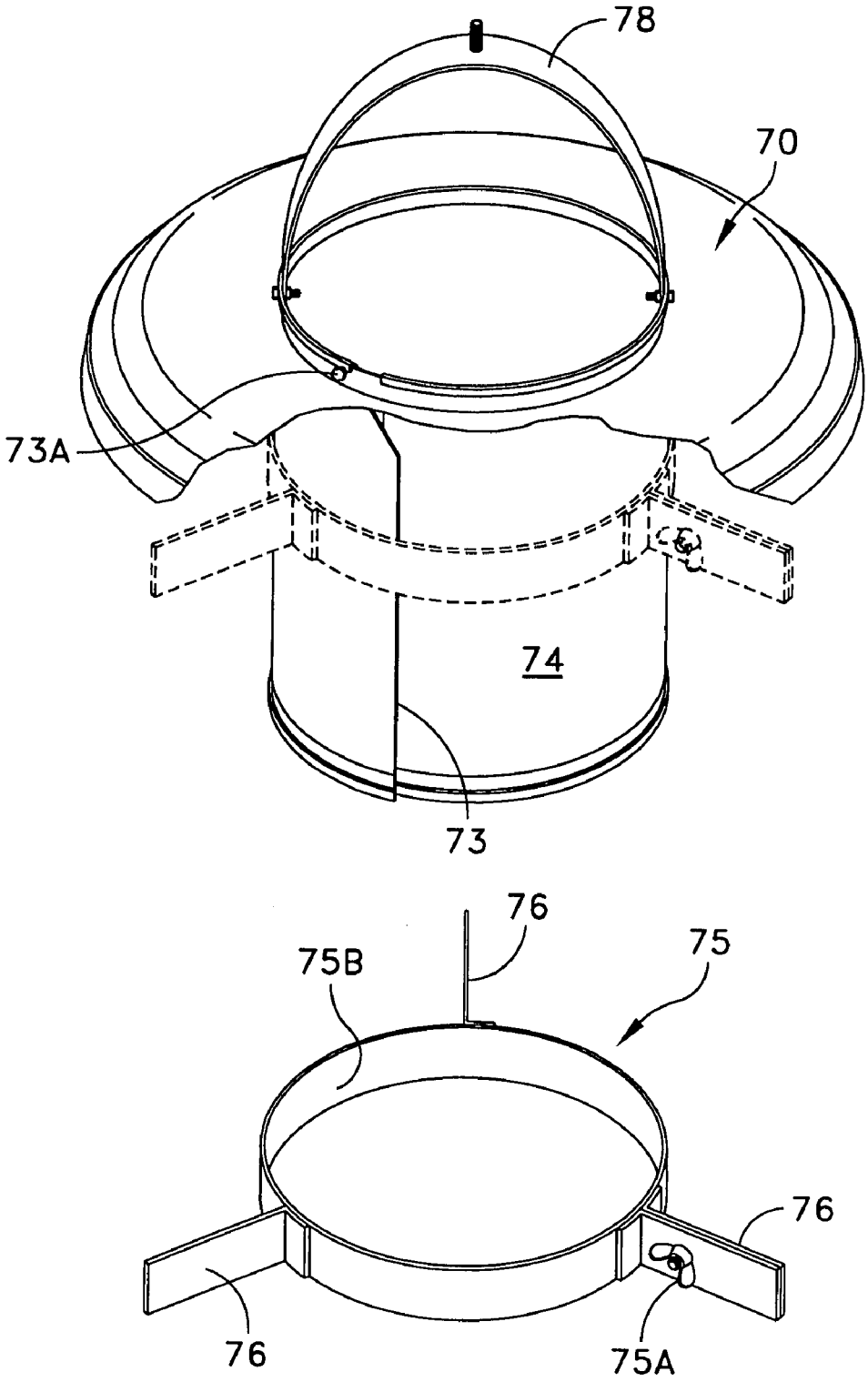
FIG. 10 is an exploded perspective view of an alternate embodiment of the chimney cap of the present invention.
Figure 11:
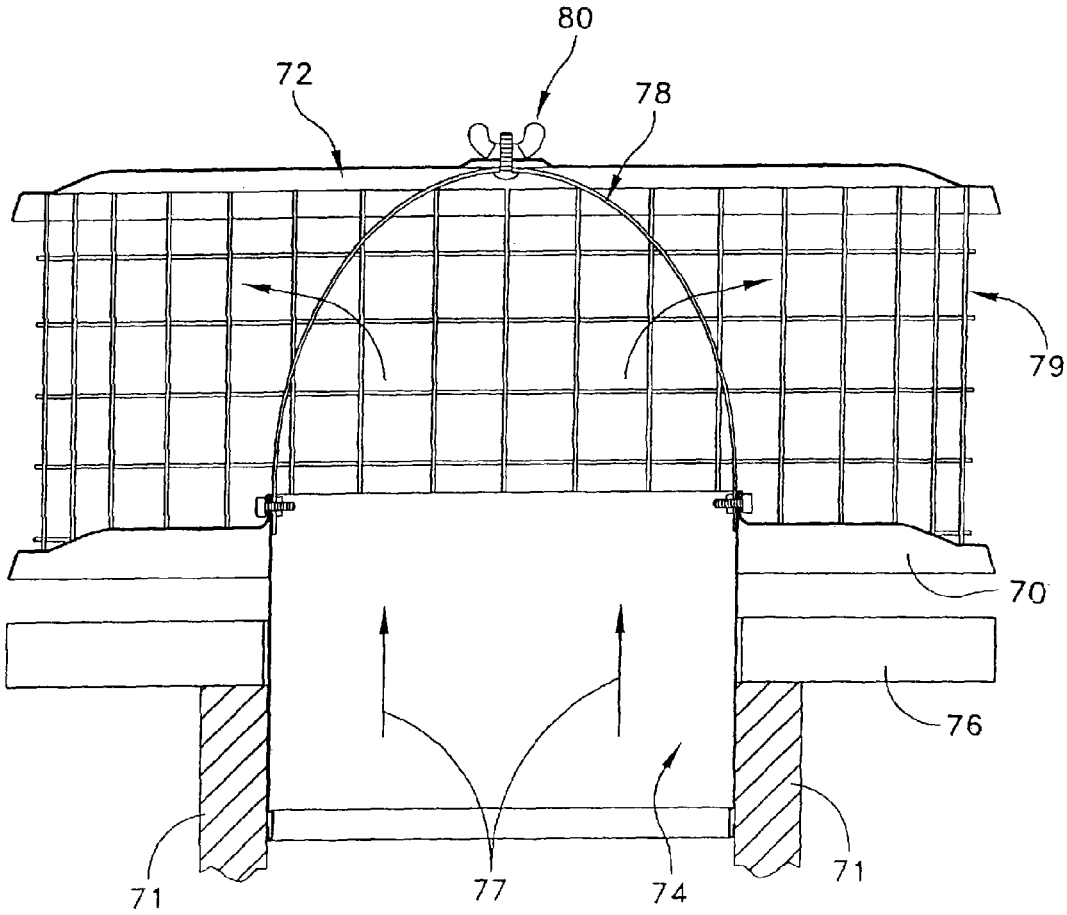
FIG. 11 is a cross-sectional view of the embodiment of FIG. 10.
Figure 12:
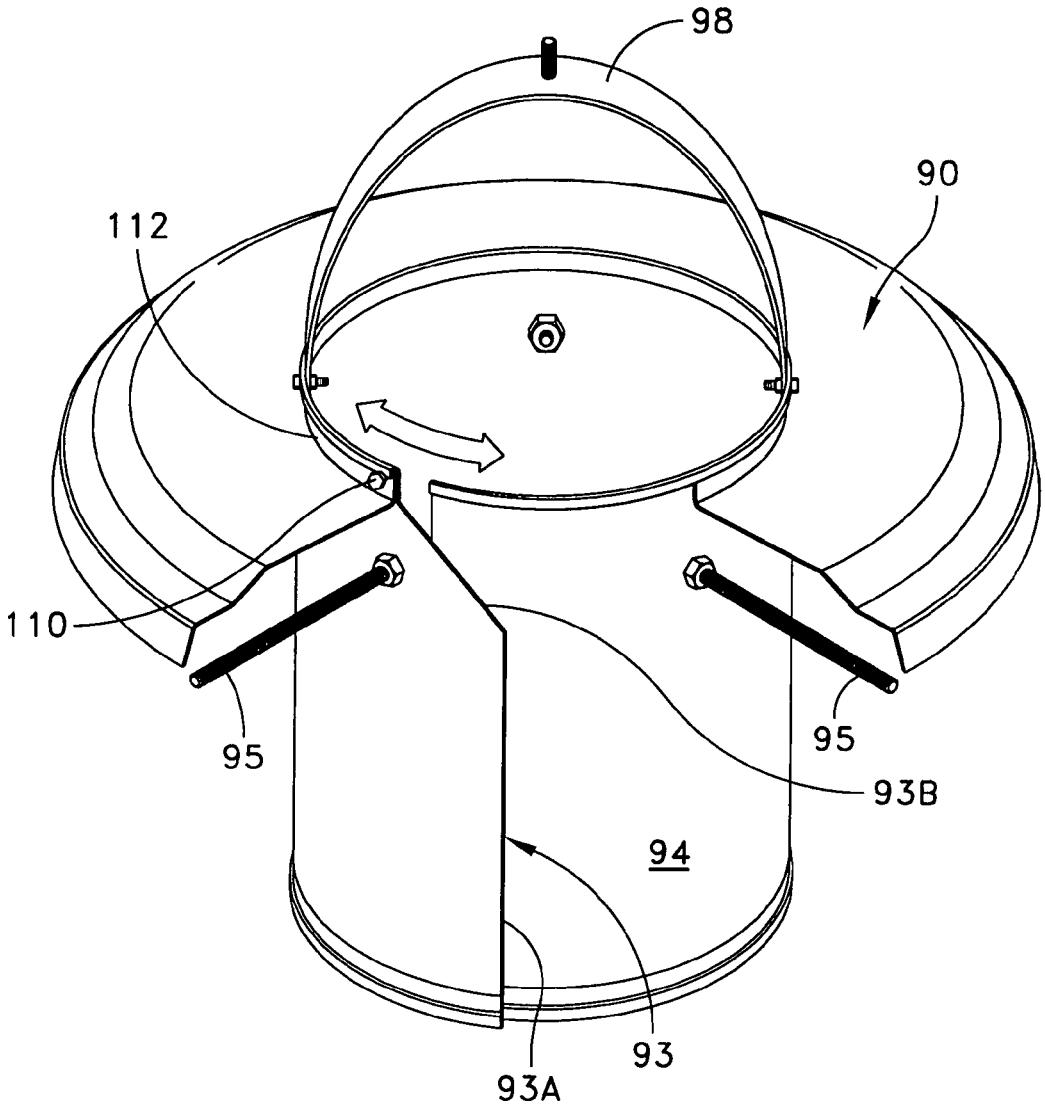
FIG. 12 is a perspective view of a further embodiment of the chimney cap of the present invention.
Figure 13:
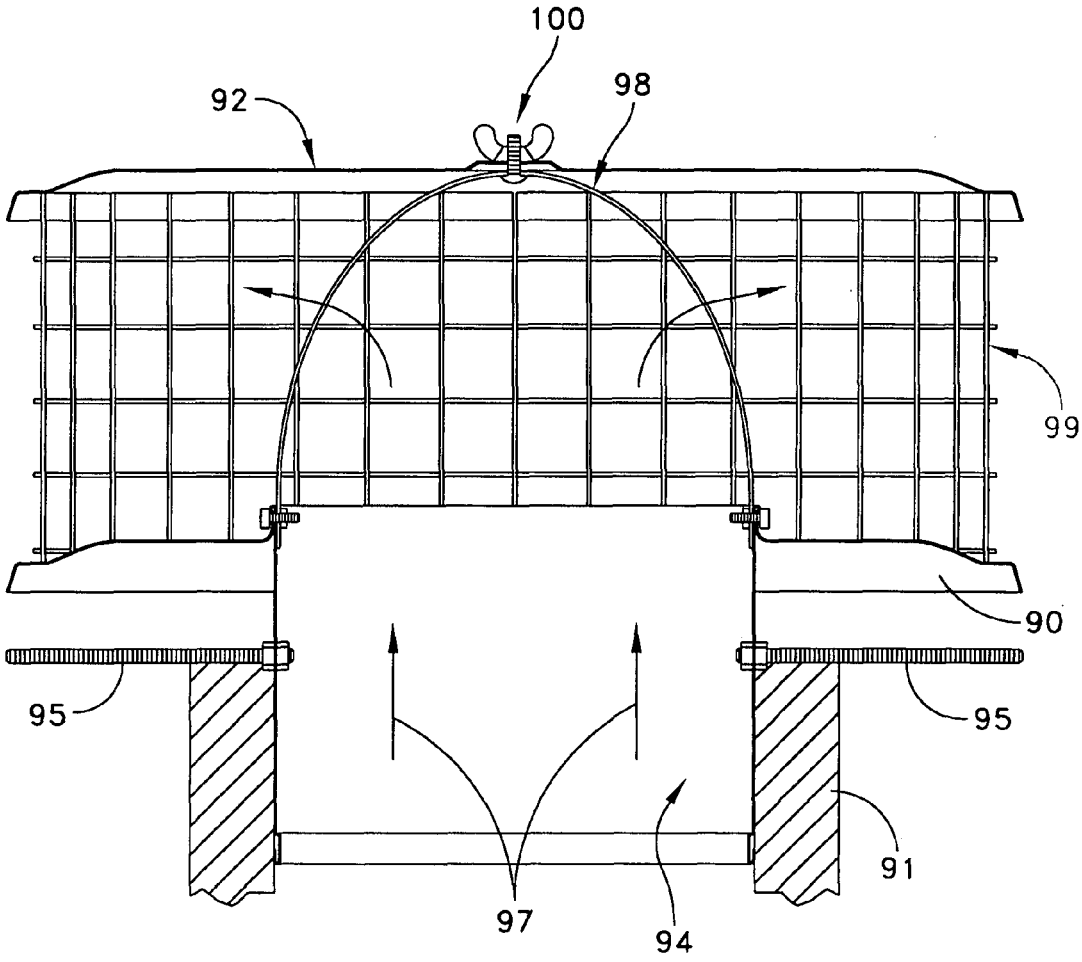
FIG. 13 is a cross-sectional view of the embodiment of FIG. 12.
Figure 14:
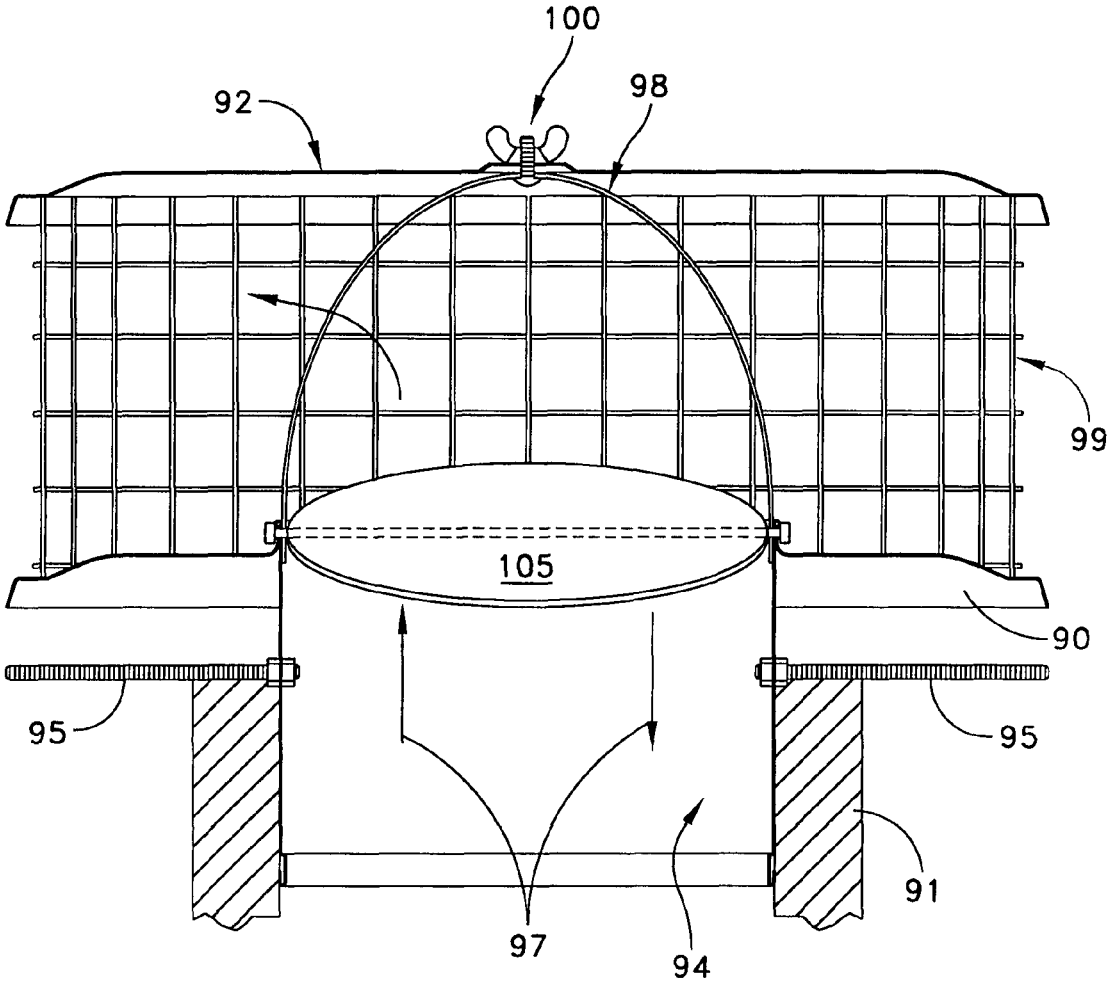
FIG. 14 is a cross-sectional view of the chimney cap of FIG. 12 with an added damper.

A first embodiment of the present invention is shown in FIGS. 5-9. A second embodiment is shown in FIGS. 10 and 11. A third embodiment is shown in FIGS. 12-14. Each of these embodiments shows a chimney cap capable of being secured to a chimney or flue of either an air-cooled or non-air-cooled type. This enables one to have only one type of chimney cap that can be used with either an air-cooled or non-air-cooled type chimney. The chimney cap generally includes a base, an annular collar member for insertion into a chimney or flue, an annular shaped mesh member that is supported from the base; and a top supported on the annular shaped mesh member.

In the first embodiment shown in FIGS. 5-9 the chimney cap includes a base 50 that has the collar 54 depending therefrom. As shown in, for example, FIG. 7, the collar 54 extends into the chimney member 55. The collar is formed with an overlap edge 53 (FIGS. 5 and 6) that makes the collar somewhat compressible so that it can be fit inside the chimney member 55. The chimney cap also includes the top 52 and mesh screen 56. The mesh screen 56 assists in containing sparks within the cap. A hoop 58 is supported above the collar 54. The mesh screen 56 is supported on the periphery of the base 50. The mesh screen 56 and top 52 are maintained in place by means of the fastener 60 engaging with the support hoop 58.

Figure 1:
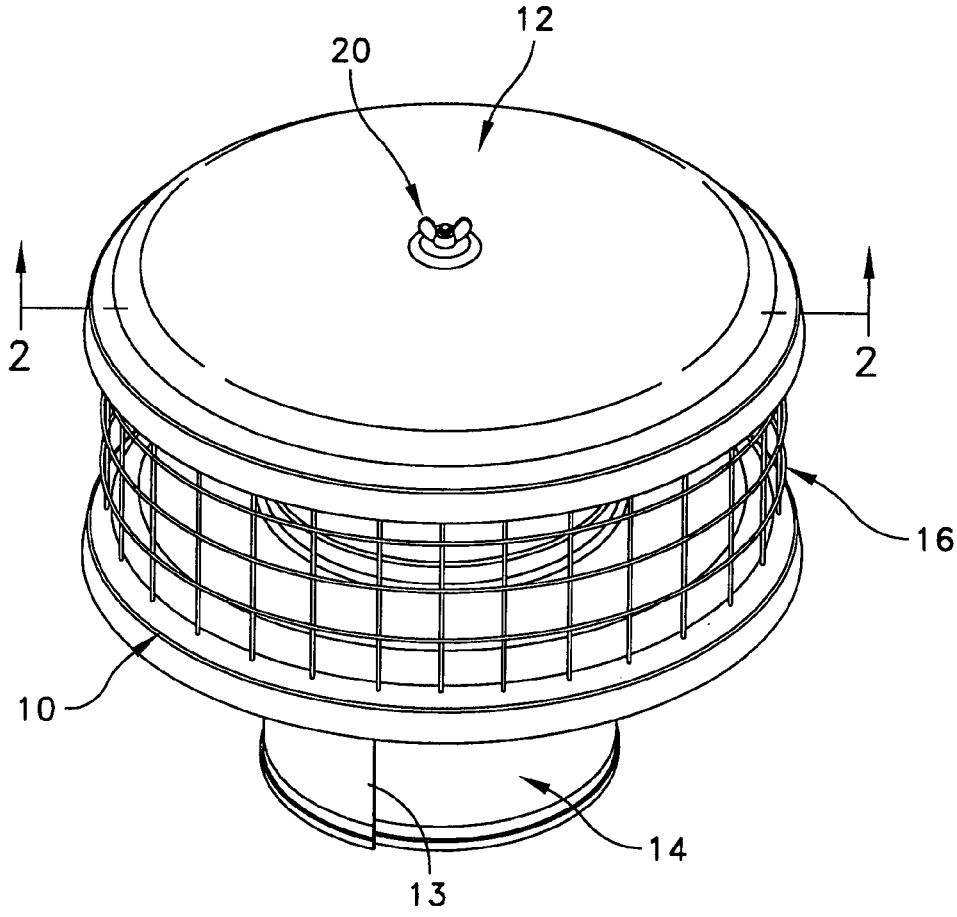
FIG. 1 (PRIOR ART)
FIG. 1 is a perspective view of a prior art chimney cap used with a non-air cooled chimney structure.
Figure 2:
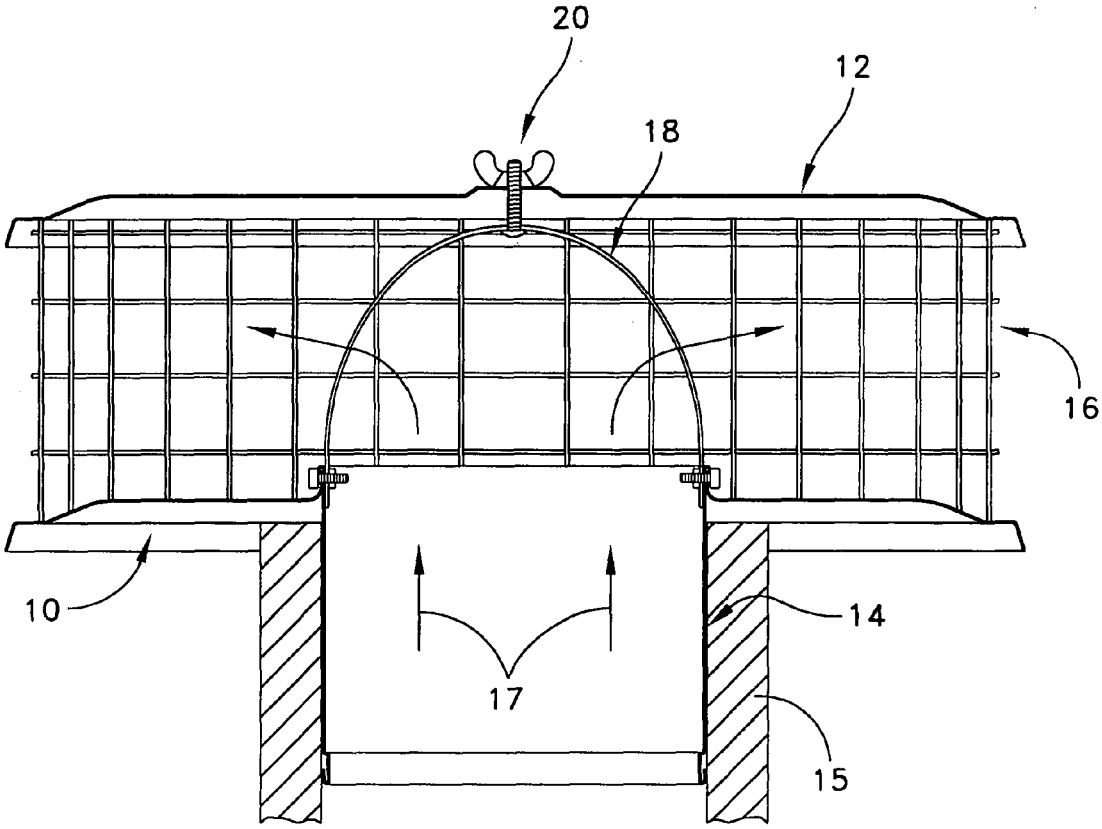
FIG. 2 (PRIOR ART)
FIG. 2 is a cross-sectional view taken along lines 2-2 of FIG. 1.
Figure 3:
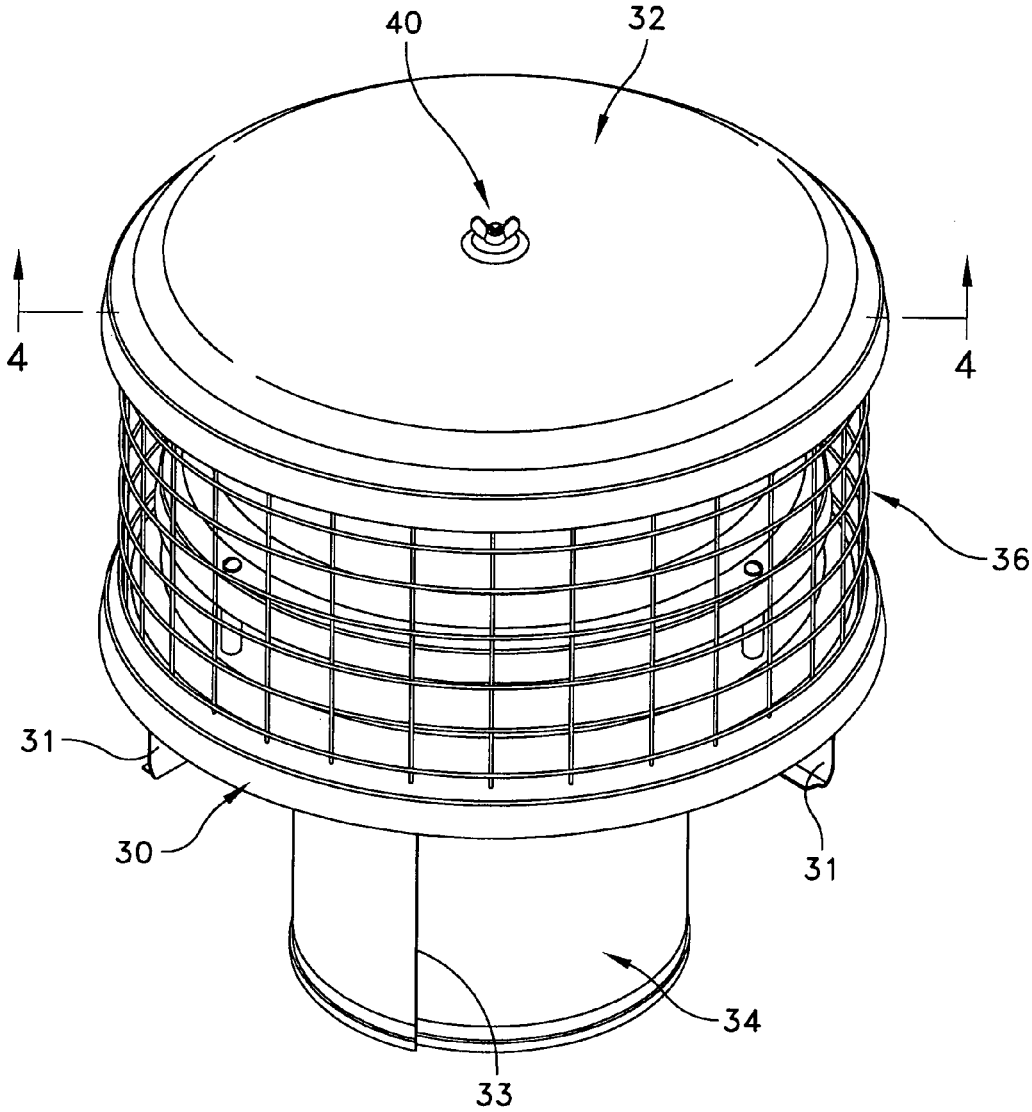
FIG. 3 (PRIOR ART)
FIG. 3 is a perspective view of a prior art chimney cap used with an air cooled chimney structure.
Figure 4:
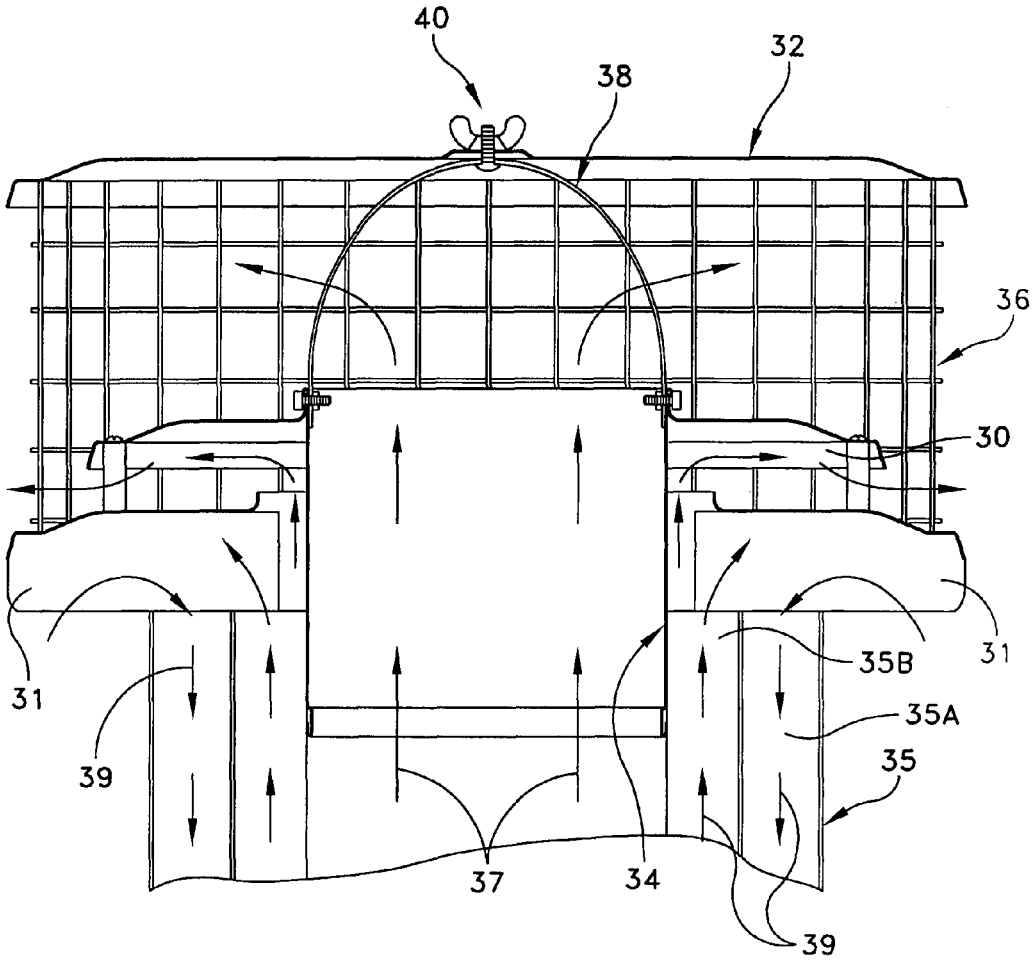
FIG. 4 (PRIOR ART)
FIG. 4 is a cross-sectional view taken along line 4-4 of FIG. 3.
Figure 5:
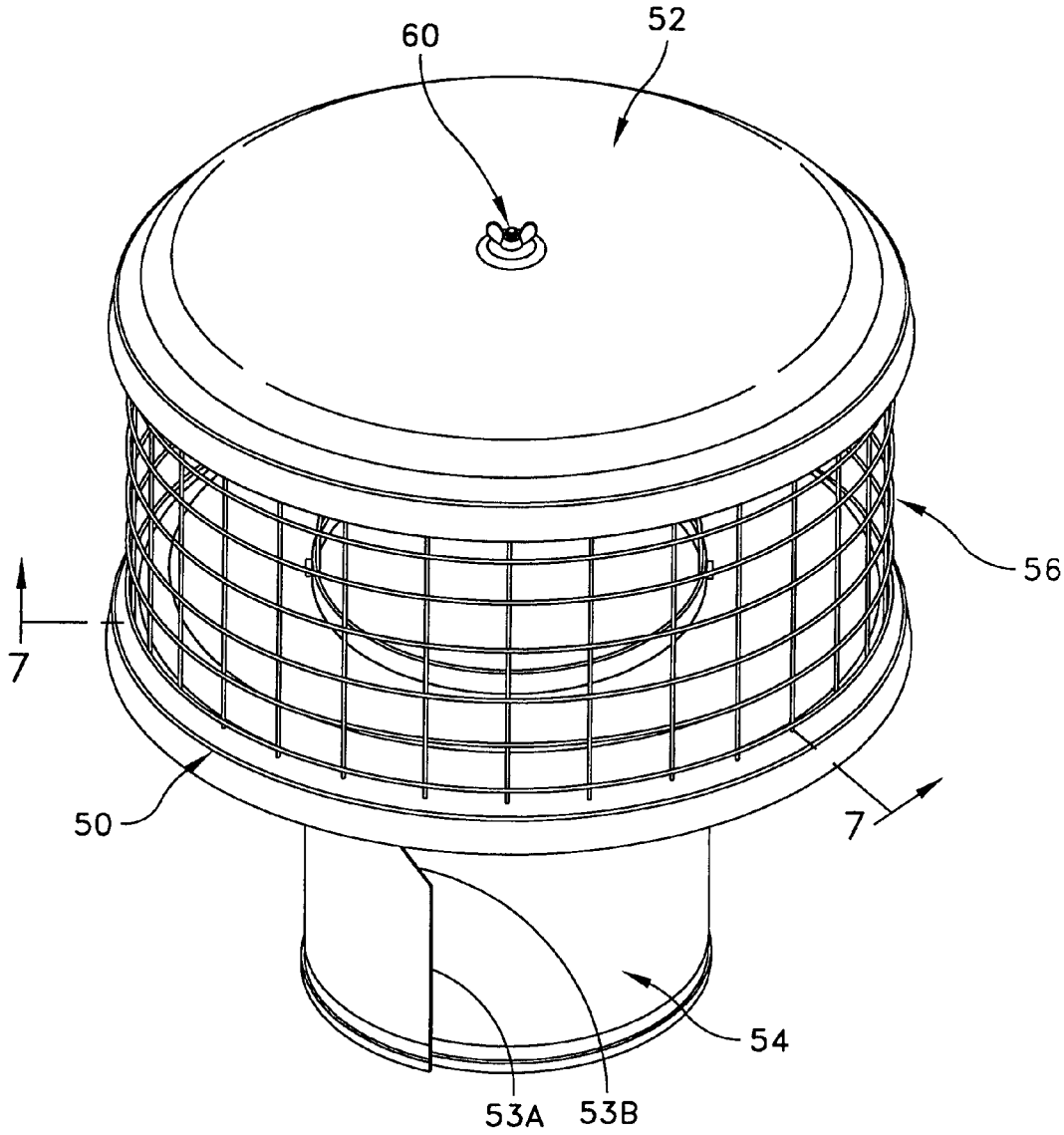
FIG. 5 is a perspective view of a first embodiment of the improved chimney cap construction of the present invention
Figure 6:
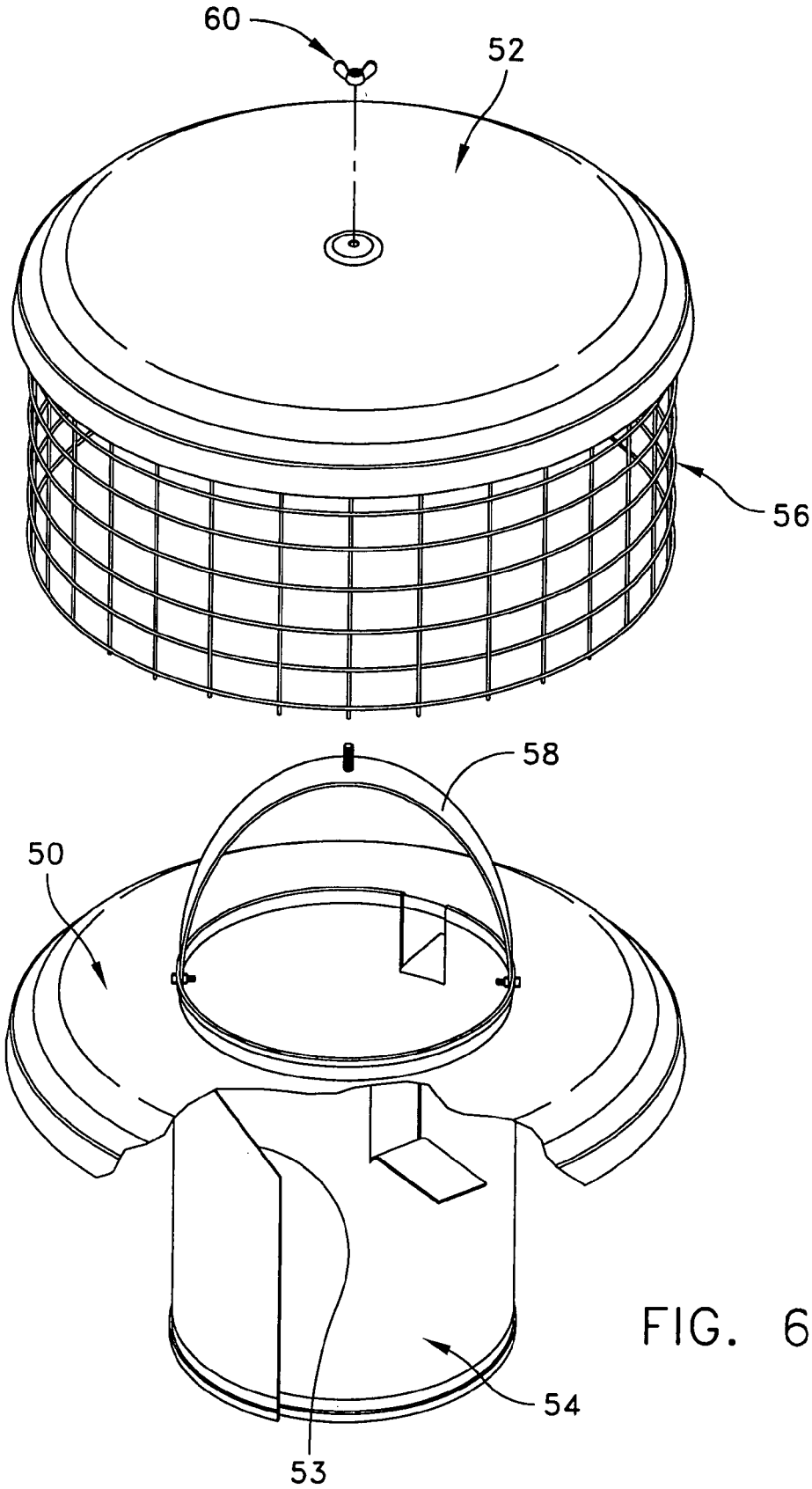
FIG. 6 is an exploded perspective view of the chimney cap of FIG. 5.

One important aspect of the present invention relates to the particular configuration of the over lap joint 53. In the past this joint was linear from bottom to top as shown in, for example, FIG. 3 where the top end of the joint is secured at the base. In the embodiments of FIGS. 5-14 the over lap joint includes a lower segment 53A that extends substantially longitudinal of the collar member and a top segment 53B that extends diagonal to the lower segment 53A enabling more ready compression of the diameter of the collar member 54. The collar member 54 may be attached at its top to the base 50 and the top segment 53B is tapered terminating at the base 50. The top termination is preferably defined by a fastener such as fastener 110 shown and discussed in more detail in FIG. 12.

Figure 7:
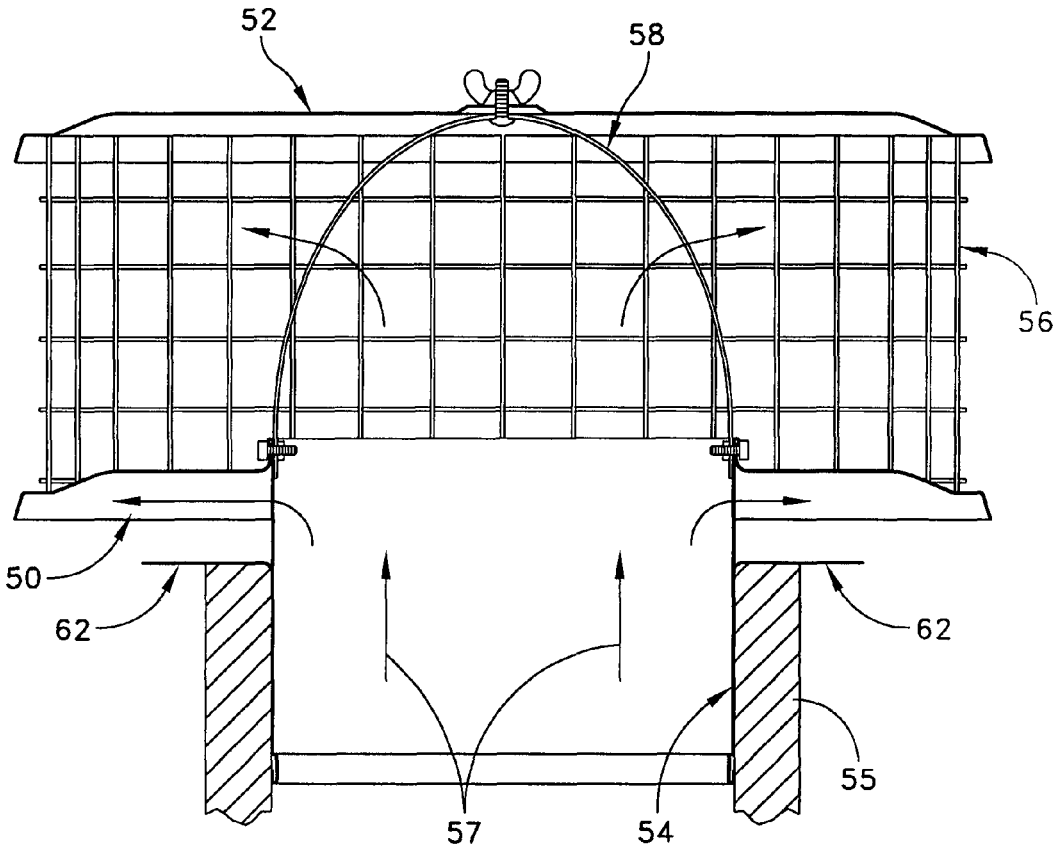
FIG. 7 is a cross-sectional view taken along lines 7-7 of FIG. 5.
Figure 8:
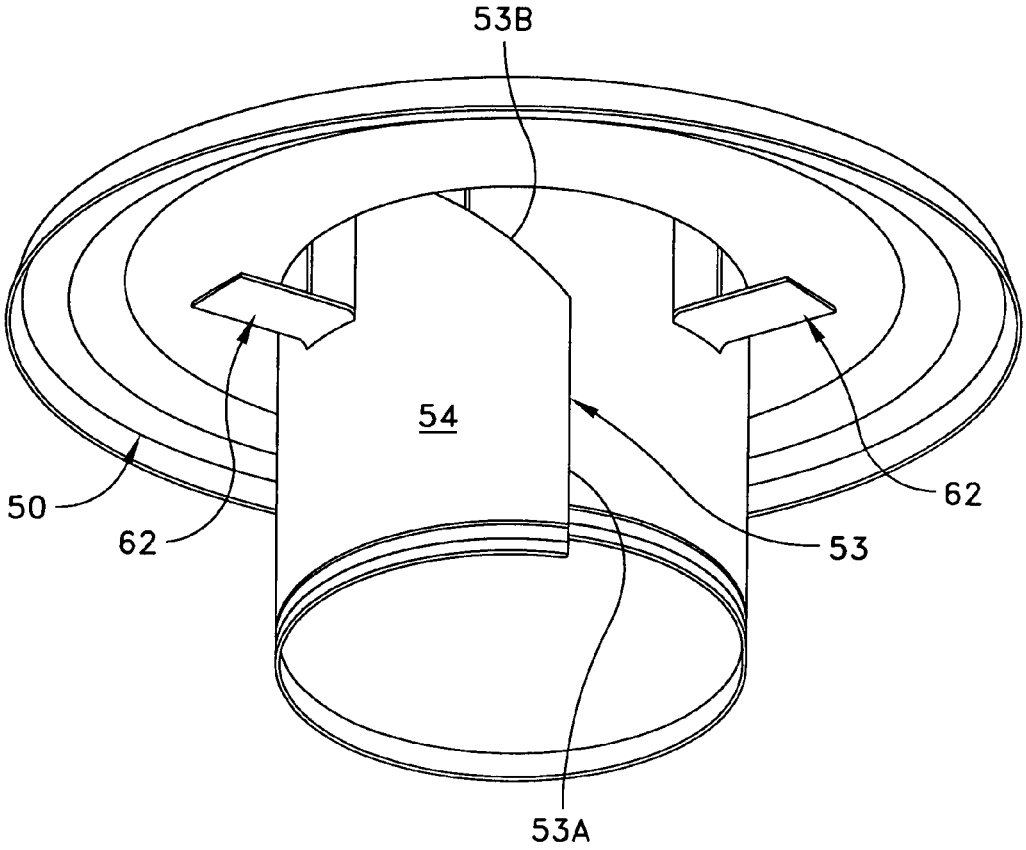
FIG. 8 is a bottom perspective view of the chimney cap of FIG. 5.
Figure 9:
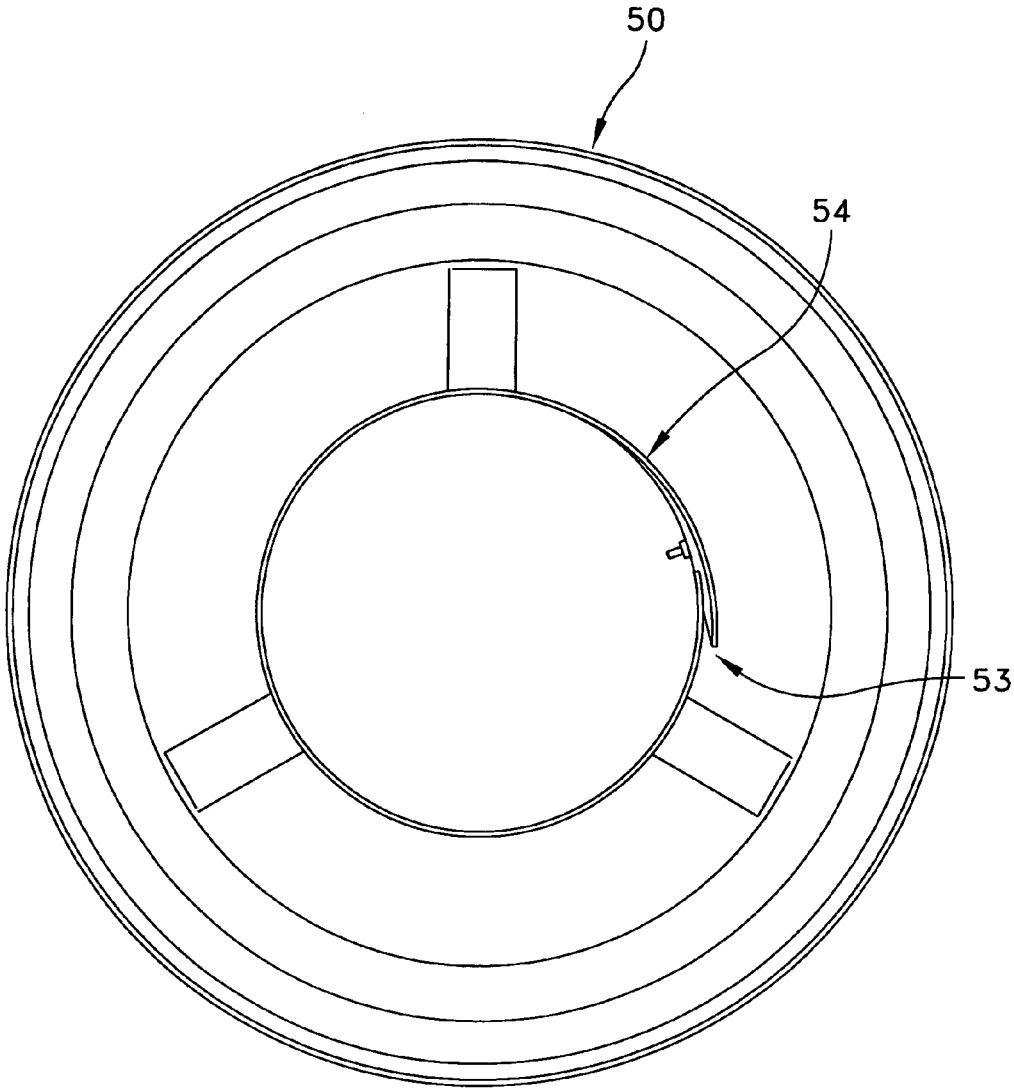
FIG. 9 is a bottom view of the chimney cap of FIG. 5.

Another important aspect of the present invention relates to the mounting arrangement that enables more universal use of the chimney cap of the present invention. In the first embodiment, shown in FIGS. 5-9 the means forming a ledge for support of the collar member from the chimney or flue includes the cut-out member or tab 62. The tab 62 may be formed by cutting out the collar member and bending the cut-out portion. The tab 62 forms a ledge that, as shown in FIG. 7, rests on the top surface of the flue or chimney. In FIG. 7 arrows 57 show the direction of gas flow out of the chimney structure. Although a small amount of flow may occur over each tab 62, the majority of the flow is out through the mesh screen 56.

In the second embodiment, shown in FIGS. 10-11 the means forming a ledge for support of the collar member from the chimney or flue includes the band member 75. In this embodiment, rather than forming the ledge from the collar member itself, a separate member is used to form the ledge, or actually a series of ledges. The band member may be held in place with a fastener 75A, as shown in FIG. 10. The band member 75 is thus easily adjustable to different vertical positions along the collar member 74. The band member 75 supports three tabs 76 that are disposed about the periphery of the main loop 75B of the band member 75. The tabs 76 form a ledge that, as shown in FIG. 11, rests on the top surface of the flue or chimney 71.

In FIG. 11 arrows 77 show the direction of gas flow out of the chimney structure. The flow is basically through the collar member 74, upward and radially out through the mesh screen 79. FIGS. 10 and 11 also show the base 70, collar member 74, support loop 78, top 72, fastener 80 and mesh screen 79. FIG. 10 also shows the overlap edge 73 that includes the two aforementioned parts terminating at the fastener 73A which functions as a pivot to assist in the compression of the collar 74.

In the third embodiment, shown in FIGS. 12-14 the means forming a ledge for support of the collar member from the chimney or flue includes the bolts 95. The bolts 95 form a ledge that, as shown in FIG. 13, rests on the top surface of the flue or chimney 91. In FIG. 13 arrows 97 show the direction of gas flow out of the chimney structure. The flow is basically through the collar member 94, upward and radially out through the mesh screen 99. FIGS. 12-14 also show the base 90, collar member 94, support loop 98, top 92, fastener 100 and mesh screen 99.

In FIG. 12 there is also clearly shown the overlap edge 93 that includes the two aforementioned parts terminating at the fastener 110 which functions as a pivot to assist in the compression of the collar 94. In the embodiments of FIGS. 12-14 the over lap joint includes a lower segment 93A that extends substantially longitudinal of the collar member and a top segment 93B that extends diagonal to the lower segment 93A enabling more ready compression of the diameter of the collar member 94. The collar member 94 may be attached at its top to the base 90 and the top segment 93B is tapered terminating at the base. The top termination is preferably defined by a fastener such as fastener 110 shown in FIG. 12. The fastener 110 may be a screw or rivet attached at the rim 112 and located at the top end of the diagonal segment 93B. This fastener functions as a pivot point that enables the collar member to be compressed in diameter while the tapered or diagonal edge 93B assists in this compression. Such a fastener is preferably used in all of the embodiments that are described herein.

Figure 15:
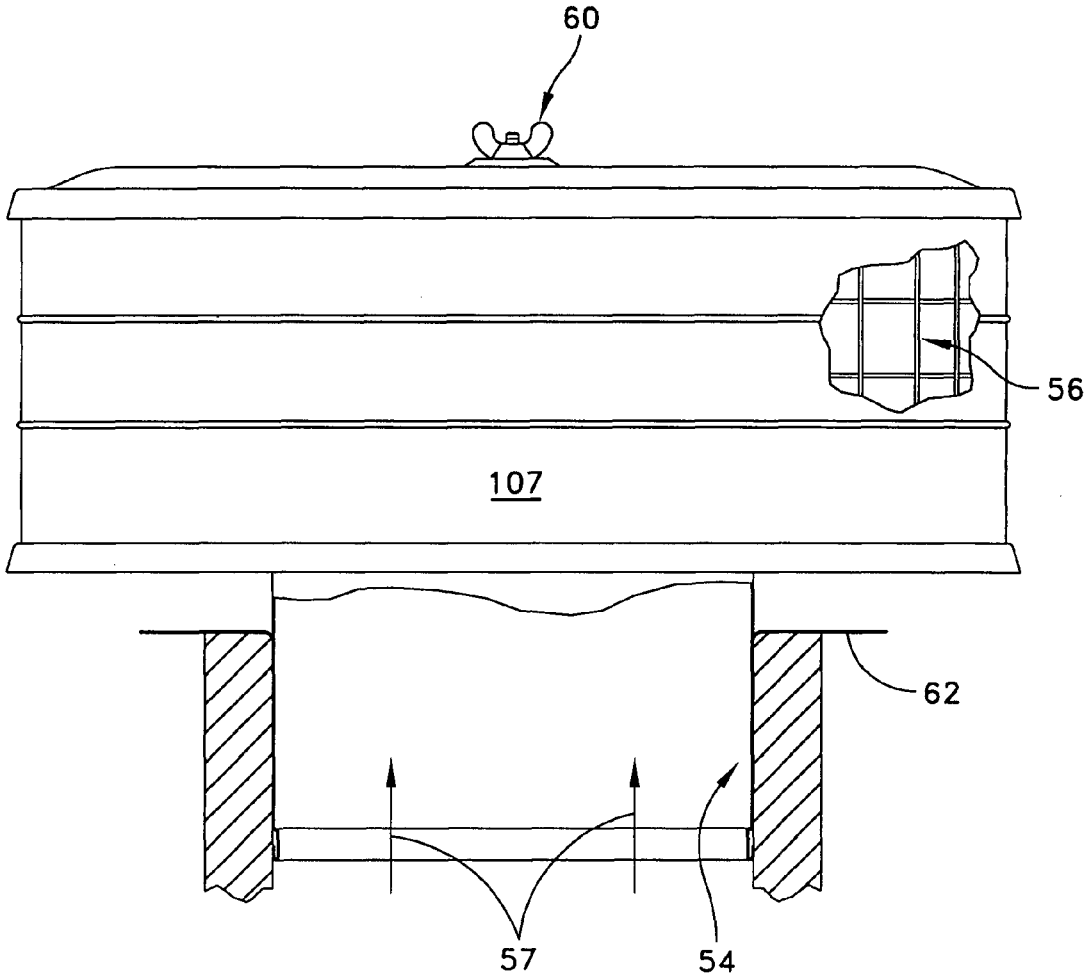
FIG. 15 shows an alternate embodiment using a sleeve.
Figure 16:
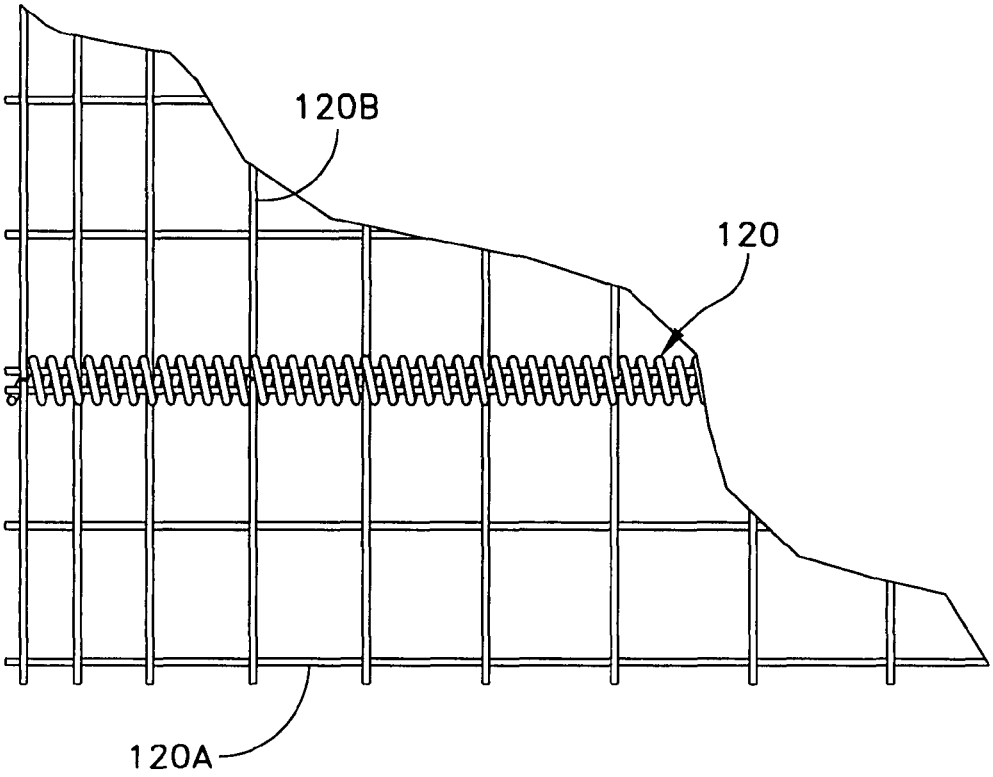
FIG. 16 shows an alternate mesh arrangement.

FIG. 14 is substantially the same as FIG. 13 but has an added damper 105 which may be controlled in a number of different ways. FIG. 15 is a view like that shown in FIG. 7 but with an added windshield 107. FIG. 16 illustrates an attachment at 120 that enables separate mesh sections 120A and 120B to be interconnected.

It is evident from the description of the preferred embodiments that the objects of the invention are attained in that a chimney cap is provided which will allow the cap collar to be more readily compressible for insertion into a chimney or flue. Although the invention has been illustrated and described in detail, it is to be clearly understood that the same is by way of illustration and example only and is not to be taken by way of limitation. Although the present invention has been disclosed in three embodiments, it is understood that other means are also contemplated as falling within the scope of the present invention and attached to the collar member. The spirit and scope of this invention is to be limited only by the appended claims.

What is claimed is:

1. A chimney cap assembly comprising:

a circular shaped base having a circular central opening and a bottom edge;

an annular collar member for insertion into a chimney or flue, said annular collar member having an outside circumference smaller than an opening of said chimney or flue and supported from said circular shaped base about said circular central opening of the circular shaped base;

an annular shaped mesh member that is supported on said base;

a support member;

fastener means for attaching the support member over the circular shaped base and for attaching the annular collar member with the circular shaped base;

said annular collar member depending downwardly from the circular shaped base so as to fit into the chimney or flue;

a top supported, by means of said support member, on said annular shaped mesh member;

said chimney or flue having an uppermost substantially flat rest surface;

means supported from an outer surface of said annular collar member below said base and forming a ledge for support of said collar member from said chimney or flue;

said ledge resting on the uppermost substantially flat rest surface of the chimney or flue and spacing the bottom edge of the circular shaped base and said annular shaped mesh member a predetermined non-zero distance above the ledge;

said means forming a ledge having at least one cut-out in said annular collar member to form the ledge, the opening of the cut-out permitting gas flow therethrough when the cap assembly is installed in the chimney.

2. The cap according to claim 1 wherein the at least one cut-out piece is folded to form the ledge, said ledge extending orthogonal to the outer surface of said annular collar member.

3. The cap according to claim 2 including plural cut-out pieces disposed at predetermined locations about said collar member.

4. The cap according to claim 1 wherein said annular collar member has an over lap joint and said support member comprises a support hoop.

5. The cap according to claim 4 wherein said over lap joint includes a lower segment that extends substantially longitudinal of said collar member and a top segment that extends diagonal to said lower segment enabling compression of the diameter of said collar member.

6. The cap according to claim 1 including a damper within said collar member.

7. A chimney cap assembly comprising:

a circular shaped base having a circular central opening defined by an inner annular surface and surrounded by a top annular radially extending surface;

an annular collar member for insertion into a chimney or flue, said annular collar member having an outside circumference smaller than an opening of said chimney or flue and supported from said circular shaped base about said circular central opening of the circular shaped base;

an annular shaped mesh member that is supported on said base;

said annular collar member depending downwardly from the circular shaped base so as to fit into the chimney or flue and having top and bottom respective edges;

a top supported on said annular shaped mesh member;

said chimney or flue having an uppermost substantially flat rest surface;

said annular collar member having an over lap joint;

said over lap joint including an external lower segment that extends substantially longitudinal of said collar member upwardly from the bottom edge of the annular collar member and an external top segment that extends diagonally from said lower segment to said top edge of said annular collar member enabling compression of the diameter of said collar member;

the lower segment of the over lap joint being contiguous with the top segment of the over lap joint;

the contiguous lower and top segments of the over lap joint being joined at a transition point where the over lap joint transitions from the substantially longitudinally extending lower segment to the diagonal top segment;

and a fastener at the top edge of the annular collar member for securing the top edge of the annular collar member to the inner annular surface of the base, said fastener functioning as a fixed position pivot point from which the bottom edge of the annular collar member along the lower segment thereof is enabled to be compressed in diameter.

8. A cap according to claim 7 wherein said collar member is attached at its top to the base and said top segment is tapered terminating at said base.

9. A cap according to claim 7 including means supported from an outer surface of said collar member below said base and forming a ledge for support of said collar member from said chimney or flue.

10. The cap according to claim 9 wherein said means forming a ledge includes a cut-out piece that is folded to form the ledge, said ledge extending orthogonal to the outer surface of said collar member.

11. The cap according to claim 10 including plural cut-out pieces disposed at predetermined locations about said collar member.

12. The cap according to claim 9 wherein said means forming a ledge comprises plural separate means disposed at predetermined locations about said collar member.

13. The cap according to claim 9 wherein said means forming a ledge includes a series of bolts disposed at intervals about said collar member and each extending outward radially.

14. The cap according to claim 9 wherein said means forming a ledge includes a band member having separately disposed ledge walls.

* * * * *